US005438901A

United States Patent [19]

Sperzel

[11] Patent Number: 5,438,901

[45] Date of Patent: Aug. 8, 1995

[54] STRING SUPPORT FOR MUSICAL INSTRUMENT

[76] Inventor: Robert J. Sperzel, 7810 Lake Ave., Cleveland, Ohio 44102

[21] Appl. No.: 344,529

[22] Filed: Nov. 23, 1994

Related U.S. Application Data

[63] Continuation of Ser. No. 963,074, Oct. 19, 1992, abandoned.

[51] Int. Cl.[6] ..... G10D 3/00; G10D 3/06

[52] U.S. Cl. ..... 84/297 R; 84/314 N

[58] Field of Search ..... 84/297 R, 298, 299, 84/307, 308, 309, 314 N

[56] References Cited

U.S. PATENT DOCUMENTS 4,304,163 12/1981 Siminoff ..... 84/314 N
5,173,565 12/1992 Gunn ..... 84/298
5,260,504 11/1993 Turner ..... 84/297 R

*Primary Examiner*—Michael L. Gellner
*Assistant Examiner*—Cassandra C. Spyrou
*Attorney, Agent, or Firm*—Tarolli, Sundheim & Covell

[57] ABSTRACT

A stringed musical instrument of the guitar type has a plurality of strings which extend from tuning devices on a head portion, along a neck portion, to a body portion of the instrument. A plurality of string supports are mounted adjacent to a connection between the head and neck portions. Each of the string supports includes a pair of spheres which are held in engagement with each other. One of the strings presses against each pair of the spheres to position the string relative to the head and neck portions of the instrument. In one embodiment of the invention, a plurality of string support assemblies are mounted on a metal base disposed on the musical instrument. In another embodiment of the invention, the string support assemblies are mounted in spaced apart openings formed in the material of the musical instrument.

30 Claims, 3 Drawing Sheets

STRING SUPPORT FOR MUSICAL INSTRUMENT

This is a continuation of application Ser. No. 07/963,074 filed on Oct. 19, 1992, now abandoned.

BACKGROUND OF THE INVENTION

The present invention relates to a new and improved string support system for use with a guitar or similar stringed instrument to position strings relative to the instrument.

Stringed musical instruments of the guitar type commonly have a body portion, a neck portion which extends outwardly from the body portion, and a head portion connected with an end of the neck portion opposite from the body portion. A plurality of tuning devices are mounted on the head portion and are operable to adjust the tension in strings which extend from the head portion along the neck portion to the body portion of the instrument. A nut or string support system is provided adjacent to a connection between the head and neck portions of the instrument. The nut positions the strings relative to the neck portion of the instrument.

The manner in which the nut cooperates with the strings is very important in obtaining the desired tone from the instrument. Thus, the nut must be accurately located to determine the effective length of the strings. The nut must hold the strings against sidewise movement in order to avoid a buzzing sound effect. During the operation of a tremolo, the nut should allow the tension in the strings to be varied in a predictable manner. The nut should be constructed in such a manner as to enable a uniform spacing to be obtained between each of the strings and the frets on the neck of the guitar.

In the past, the nut has included a straight piece of material in which slots are formed. Substantial care and effort is required to form the slots in the nut with a width which corresponds exactly to the diameter of the strings to prevent sidewise movement of the strings. In addition, the orientation of the slots must be carefully and accurately determined to have the strings go straight back from a front edge of the nut to the tuning devices on the head portion of the guitar. In addition, substantial effort must be expended to form the slots with a depth which will result in each of the strings being spaced the same distance from an arcuate upper side surface on each of the frets on the neck of the guitar. Unfortunately, after the guitar is used over a period of time, the nut wears and must be replaced.

SUMMARY OF THE INVENTION

An improved string support system is used in a musical instrument of the guitar type. This type of musical instrument commonly has a plurality of strings which extend from tuning devices on a head portion, along a neck portion, to a body portion of the instrument. The improved string support system positions the strings relative to the head and neck portions of the instrument.

The string support system includes a plurality of string support assemblies. Each of the string support assemblies has a pair of convex arcuate surfaces which cooperate to engage a string. The convex arcuate surfaces may be disposed on spherical members. The spherical members may be rotatably held in a recess formed in a support member. The support member may be mounted on a base which is in turn mounted on the instrument or may be mounted directly in the material of the instrument.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
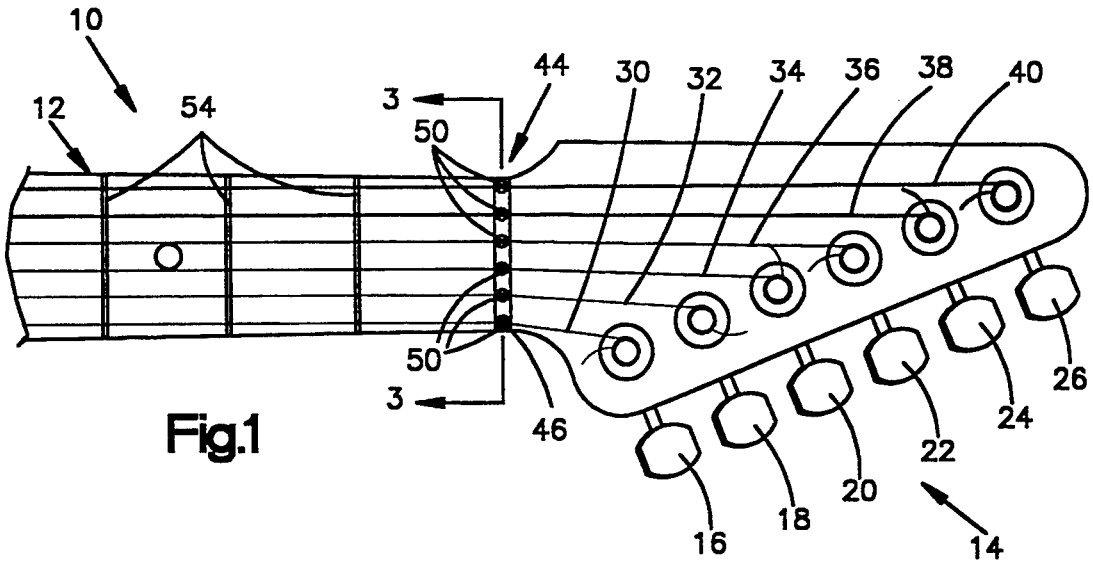
FIG. 1 is a fragmentary and somewhat schematicized plan view illustrating the relationship between a neck portion, head portion and a plurality of strings in a musical instrument of the guitar type.

A portion of a guitar 10 is shown in FIG. 1. The guitar 10 includes a body portion (not shown) having a sounding board. A neck portion 12 extends outwardly from the body portion of the guitar. A head portion 14 is connected with the neck portion 12. The head and neck portions 12 and 14 are formed of wood. However, the head and/or neck portions 12 and 14 could be formed of a different material if desired.

A plurality of tuning devices 16, 18, 20, 22, 24 and 26 are provided on the head portion 14. The tuning devices 16–26 are operable to adjust the tension in strings 30, 32, 34, 36, 38 and 40 in a known manner. The tuning devices 16–26 are advantageously constructed in the manner disclosed in U.S. Pat. No. 4,625,614

The strings 30–40 extend from the tuning devices 16–26 in the head portion 14 along the neck portion 12 of the guitar to the body portion of the guitar. A tremolo may be provided on the body portion to vary the tension in the strings 30–40 in a known manner. The general construction of the guitar 10 is well known and may be in accordance with the construction of may different commercially available guitars.

An improved string support system 44 constructed in accordance with the present invention is provided adjacent to a connection 46 between the neck and head portions 12 and 14 of the guitar 10. The string support system 44 positions the strings 30–40 relative to the neck portion 12 of the guitar. The string support system 44 performs functions performed by a nut in known guitars.

The improved string support system 44 includes a plurality of identical string support assemblies 50 which are disposed in a linear array. There is a string support assembly 50 for each of the strings 30–40. The string support assemblies 50 engage the strings to locate them relative to each other and to frets 54 on the neck portion 12 of the guitar 10.

Figure 2:
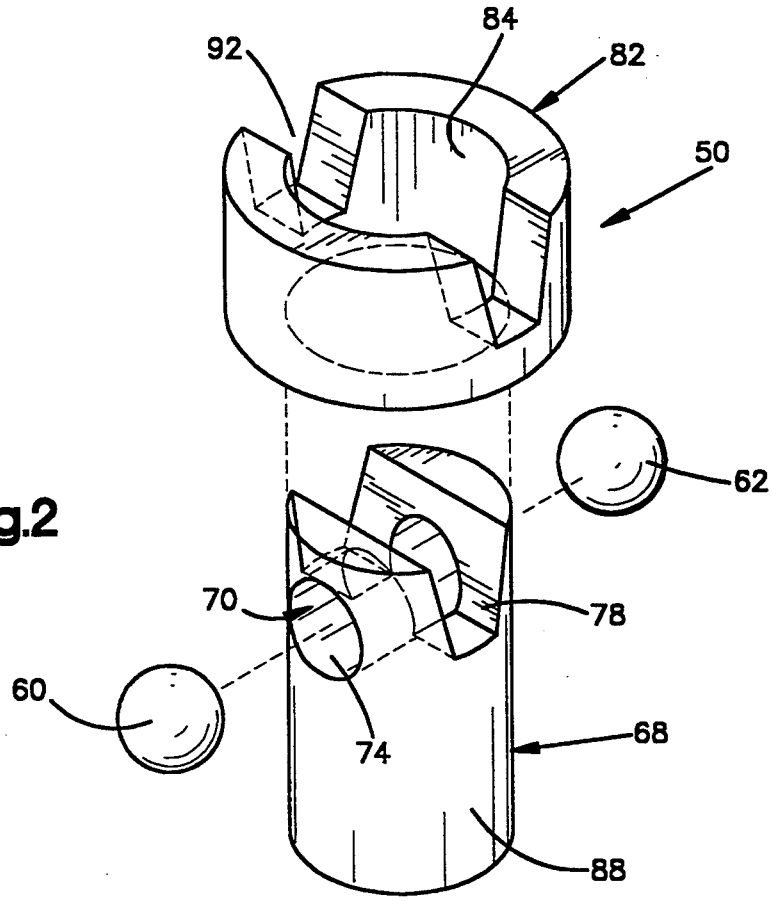
FIG. 2 is an exploded pictorial illustration depicting the relationship between components of a string support assembly constructed in accordance with the present invention.
Figure 3:
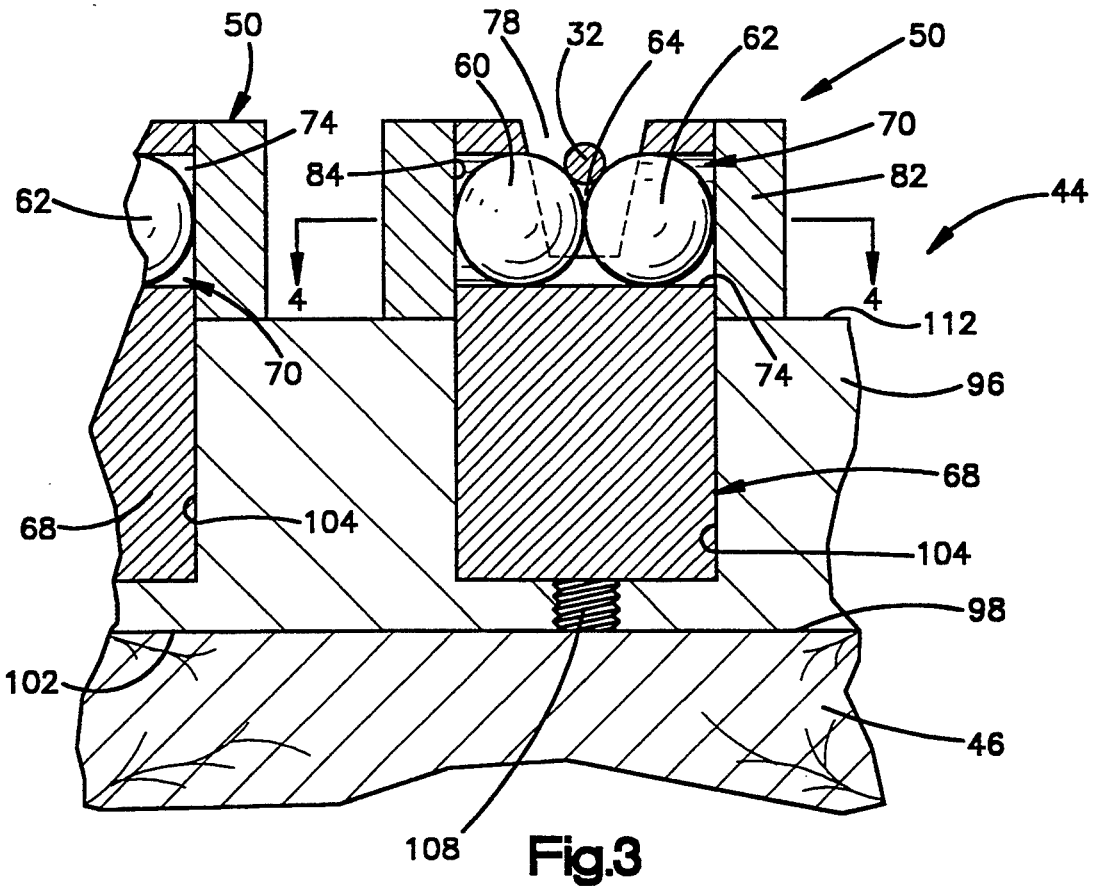
FIG. 3 is a fragmentary sectional view, taken generally along the line 3—3 of FIG. 1, illustrating the manner in which the string support assembly of FIG. 2 is mounted in a base on the musical instrument.
Figure 4:
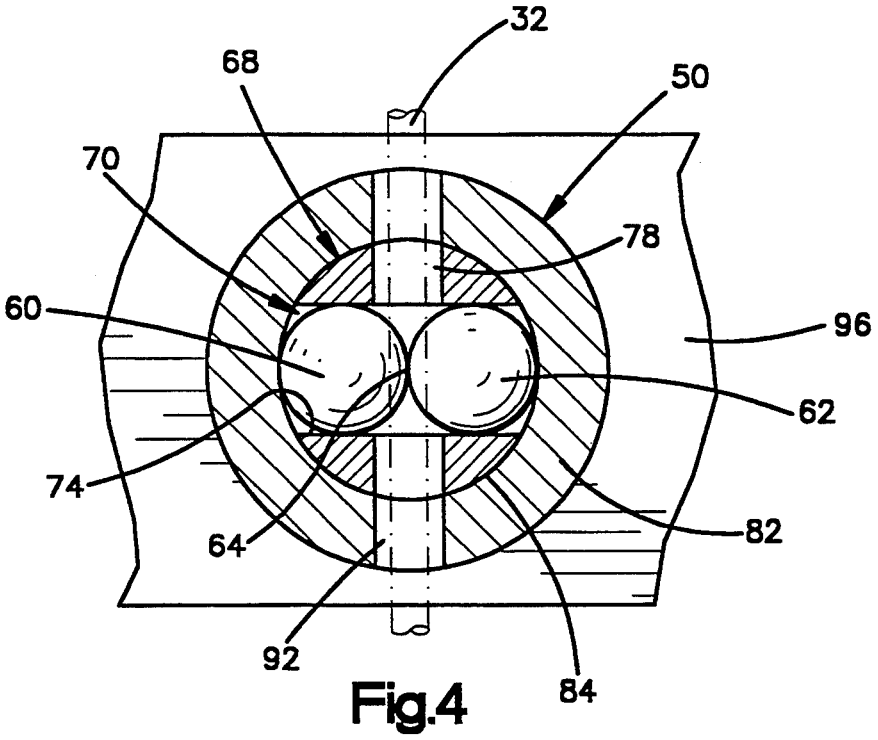
FIG. 4 is a plan view, taken generally along the line 4—4 of FIG. 3, further illustrating the construction of the string support assembly.

In accordance with one of the features of the present invention, each of the string support assemblies 50 includes a pair of spheres or balls 60 and 62 (FIGS. 2, 3 and 4). The spheres 60 and 62 are formed of metal (steel) and have convex arcuate surfaces which support one of the strings, for example the string 32 (FIGS. 3 and 4). Although it is preferred to use a pair of spheres or balls 60 and 62 in the string support assembly 50, either a single member or a pair of nonspherical members could be formed with convex arcuate surface areas which are engaged by one of the strings 30–40.

The spheres 60 and 62 enable the string 32 (FIGS. 3 and 4) to be supported at a predetermined location along the neck 12 of the guitar 10 to provide an accurately located intonation point for the string. The spheres 60 and 62 also accurately locate the string 32 relative to the frets 54 on the neck portion 12 of the guitar 10. By providing a separate string support assembly 50 for each of the strings 30–40, the height of each of the strings above the frets 54 can be the same even though the frets have curved outer side surfaces.

In addition to accurately locating the strings 30–40, the spheres 60 and 62 cooperate with the strings to hold them against sideways movement at the string support system 44. This minimizes objectionable noise or buzzing. The convex arcuate outer side surfaces of the spheres 60 and 62 enable the strings 30–40 to extend in either a continuous straight line along the neck portion 12 and head portion 14, as shown in FIG. 1, or to bend at the string support system 44. This enables the string support assemblies 50 to be used with guitars having tuning devices in almost any desired location on the head portion of the guitar.

The spheres 60 and 62 in the plurality of string support assemblies 50 enable the strings 30–40 to have different diameters. Thus, the diameters of the strings 30–40 progressively increase from a relatively small diameter string 30 to a relatively large diameter string 40. The reason that the identical string support assemblies 50 can be used with the strings of different diameters is that the convex arcuate outer side surfaces of the spheres 60 and 62 cooperate to form a recess or nip 64 which tapers downwardly (as viewed in FIG. 3). The tapering nip 64 allows the spheres 60 and 62 to engage opposite sides of strings 30–40 having different diameters and to hold the different diameter strings against sideways movement. The spheres 60 and 62 preferably have diameters which are greater than the diameters of the strings.

Each of the string support assemblies 50 includes a cylindrical metal (brass) body 68 (FIG. 3). A cylindrical recess 70 extends diametrically across the cylindrical body 68. The recess 70 has the same nominal diameter as the hardened metal (steel) spheres 60 and 62. However, the diameter of the cylindrical recess 70 is slightly greater than the diameter of the spheres 60 and 62 so that the spheres are free to rotate in the recess 70. The diameter of the spheres 60 and 62 is greater than the diameter of the string 32.

When the string 32 is flexed during playing of the guitar 10, for example during actuation of a tremolo, the string 32 (FIGS. 3 and 4) is free to move along its longitudinal axis relative to the spheres 60 and 62. As the string 32 moves axially relative to the spheres 60 and 62, the spheres are rotated in opposite directions about their centers by forces transmitted from the string 32 to the spheres. Thus, if the string 32 was moved axially in an upward direction (as viewed in FIG. 4), the sphere 60 would rotate in a counterclockwise direction about its center while the sphere 62 would rotate in a clockwise direction about its center. The centers of the spheres 60 and 62 are disposed on the central axis of the cylindrical recess 70.

Allowing the spheres 60 and 62 to rotate under the influence of force transmitted to the spheres by the string 32 eliminates any possibility of binding or jamming of the string in support assembly 50. This tends to maximize the effect which can be obtained by the use of a tremolo. Of course, if desired, the spheres 60 and 62 could have an interference fit with a cylindrical inner side surface 74 (FIG. 2) of the recess 70 so that the spheres would not rotate in the recess.

The cylindrical body 68 has a nominal outside diameter which is the same as the combined diameter of the two spheres 60 and 62. Thus, in the illustrated embodiment of the invention wherein the spheres 60 and 62 have the same diameter, the diameter of the cylindrical body 68 is twice as great as the diameter of one of the spheres 60 or 62. Therefore, the spheres 60 and 62 extend for the entire length of the cylindrical recess 70 (FIGS. 3 and 4). However, in the illustrated embodiment of the invention, the cylindrical body 68 has a diameter which is slightly greater than twice the diameter of the two spheres 60 and 62 to facilitate rotation of the spheres.

A truncated V-shaped slot or passage 78 is formed in the cylindrical body 68 (FIG. 2). The slot 78 extends downwardly (as viewed in FIG. 2) past the longitudinal axis of the cylindrical recess 70 and the centers of the spheres 60 and 62 (FIG. 3). The slot 78 receives the string 32 (FIGS. 3 and 4) and enables the string 32 to move into the cylindrical body for a distance sufficient to engage spheres 60 and 62. In addition, the slot 78 is wide enough to enable the string 32 to bend at the location where the string engages the spheres 60 and 62. The longitudinal central axis of the slot 78 extends perpendicular to the longitudinal central axis of the cylindrical recess 70 (FIG. 2).

An annular metal (brass) collar 82 (FIG. 2) is provided to hold the spheres 60 and 62 in the cylindrical recess 70. Thus, the collar 82 circumscribes the cylindrical body 68 and extends across opposite ends of the recess 70. The collar 82 has a cylindrical inner side surface 84 which is engageable by the spheres 60 and 62 (FIGS. 3 and 4) to hold them in the cylindrical recess 70.

The inside diameter of the collar 82 is slightly greater than the combined diameters of the two spheres 60 and 62 so that the spheres are free to rotate in the cylindrical recess 70. However, the cylindrical inner side surface 84 (FIG. 2) of the collar 82 has an interference fit with a cylindrical outer side surface 88 of the body 68 to hold the collar 82 against rotation relative to the body 68. Of course, if the spheres 60 and 62 are to be held against rotation, the inner side surface 84 of the collar 82 could be sized to have a slight interference fit with the spheres 60 and 62.

A truncated V-shaped slot 92 (FIGS. 2 and 4) extends diametrically across the collar 82. The truncated V-shaped slot 92 is axially aligned with the slot 78 in the body 68 to receive the string 32. The slot 92 in the collar 82 is of the same size and shape as the slot 78 in the body 68. If desired, the slot 92 could be slightly larger than the slot 70 to accommodate bending of the string 32 at the string support assembly 50. The string 32 extends through the slot 92 in the collar 82 and halfway through the slot 78 in the body 68 into engagement with the spheres 60 and 62. The string 32 then extends the rest of the way through the slot 78 and through the slot 92 out of the string support assembly 50 (FIG. 4).

In the embodiment of the invention illustrated in FIGS. 1–4, the string support assemblies 50 are disposed in a linear array on a metal (steel) base or mounting member 96 (FIGS. 3 and 4). The base 96 is disposed in a rectangular slot 98 formed in the material of the guitar 10 at the connection 46 between the neck portion 12 and the head portion 14 of the guitar (FIG. 3). A flat bottom side 102 of the base 96 abuttingly engages the bottom of the slot 98.

The rectangular base 96 has a plurality of spaced apart cylindrical openings 104 (FIG. 3) in which the cylindrical bodies 68 of the string support assemblies 50 are received in a linear array. There is an interference fit between the cylindrical bodies 68 of the string support assemblies 50 and the openings 104 to retain the string support assemblies 50 in the base 96. If desired, set screws may be provided in the base 96 to hold the cylindrical bodies 68 against movement relative to the base.

Height adjustment screws 108 (FIG. 3) are advantageously provided in the base 96 in association with each of the string support assemblies 50. Prior to insertion of the string support assemblies 50 into the base 96, the height adjustment screws 108 are adjusted to position the associated string support assemblies 50 at desired heights relative to the base. Thus, each pair of spheres 60 and 62 can be positioned along a path extending perpendicular to a line between centers of the spheres by the associated adjustment screw 108. This enables the string support assemblies 50 for the strings 30–40 (FIG. 1) to be set at different heights from the lower side 102 of the base 96.

By adjusting the screws 108, the height at which each of the strings 30–40 is supported can be adjusted. This enables the height of the strings 30–40 to be adjusted so that each of the strings is the same distance from an arcuately curved outer side surface of a fret 54 (FIG. 1). In the embodiment of the invention illustrated in FIG. 3, an upper side surface 112 of the base 96 is flat and extends parallel to the flat lower side surface 102 of the base. However, the upper side surface 112 of the base 96 could have a curvature which is the same as the curvature of the frets 54. Regardless of the configuration of the base 96, the height adjustment screws 108 (FIG. 3) are positioned so that the strings 30–40 are all the same distance from the arcuate outer side surfaces on the frets 54.

The spheres 60 and 62 engage opposite sides of the string 32 (FIGS. 3 and 4). Each of the strings 30–40 slopes downwardly (as viewed in FIG. 3) from an associated one of the string support assemblies 50 to an associated one of the tuning devices 16–26. Although the tuning devices 16–26 have been aligned with the string support assemblies 50 in the embodiment of the guitar 10 illustrated in FIG. 1, it is contemplated that the tuning devices 16 could be offset to either the left and/or the right relative to the associated string support assembly 50. The smooth convex arcuate outer side surface of the spheres 60 and 62 accommodates bending of the strings downwardly and/or sidewardly toward the tuning devices 16–26.

In the illustrated embodiment of the invention, each of the string support assemblies 50 has been provided with a pair of spherical members 60 and 62 to support the strings 30–40. However, only a portion of the outer side surface of each of the spheres 60 and 62 engages a string. It is contemplated that the portion of the outer side surface of a sphere which engages a string could be provided on a member which does not have a spherical configuration. For example, the spheres 60 and 62 could be formed to have a plurality of flat sides which would cooperate with a rectangular recess rather than the cylindrical recess 70. Of course, the convex arcuate outer side surface area of the sphere which engages the string would be retained.

In the illustrated embodiment of the invention, the spheres 60 and 62 are disposed in abutting engagement with each other. However, the spheres 60 and 62 could be spaced a slight distance apart if desired. Of course, the distance which the spheres 60 and 62 could move apart would not be sufficient to enable a string to pass between the spheres. To provide for firm positioning of the strings 30–40 by the spheres 60 and 62, the spheres have diameters which are greater than the largest diameter of a string.

Figure 5:
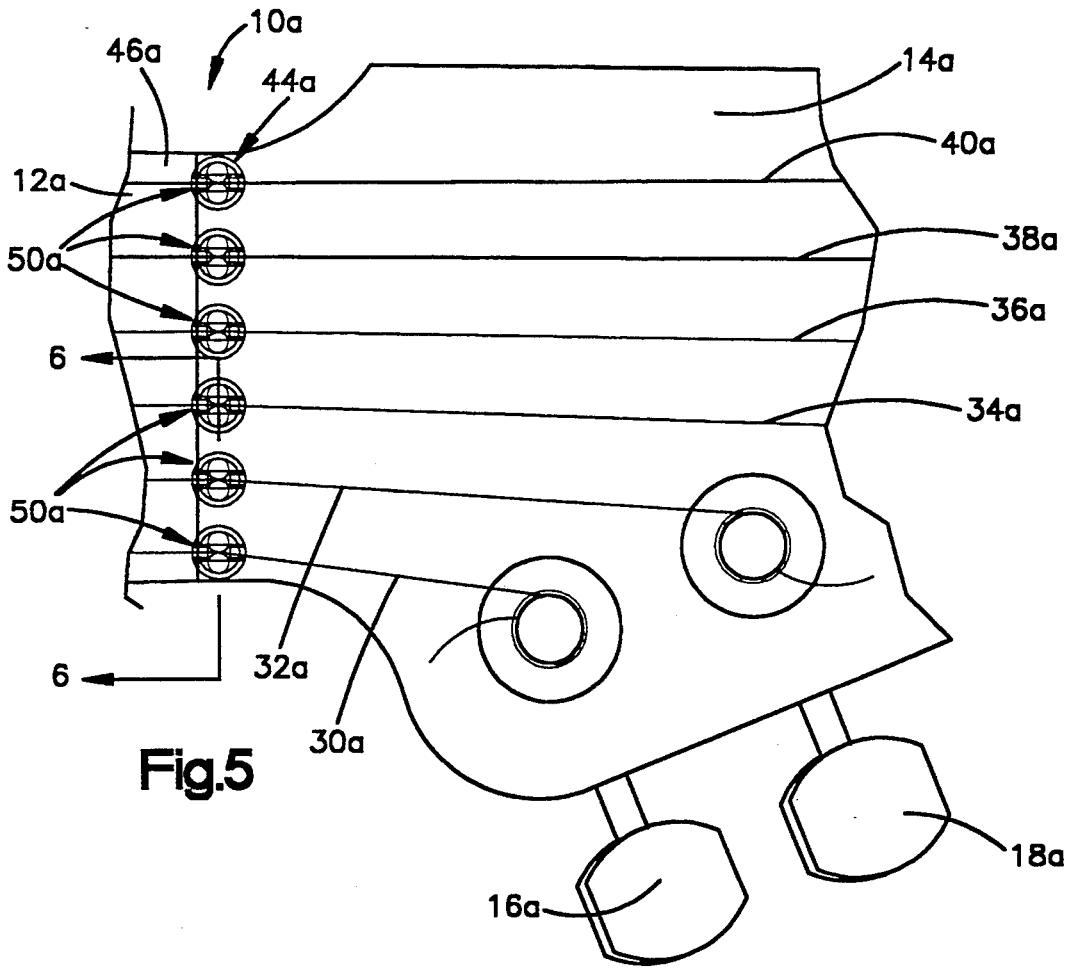
FIG. 5 is a fragmentary plan view of a second embodiment of the invention in which string support assemblies are mounted directly in the material of the musical instrument.
Figure 6:
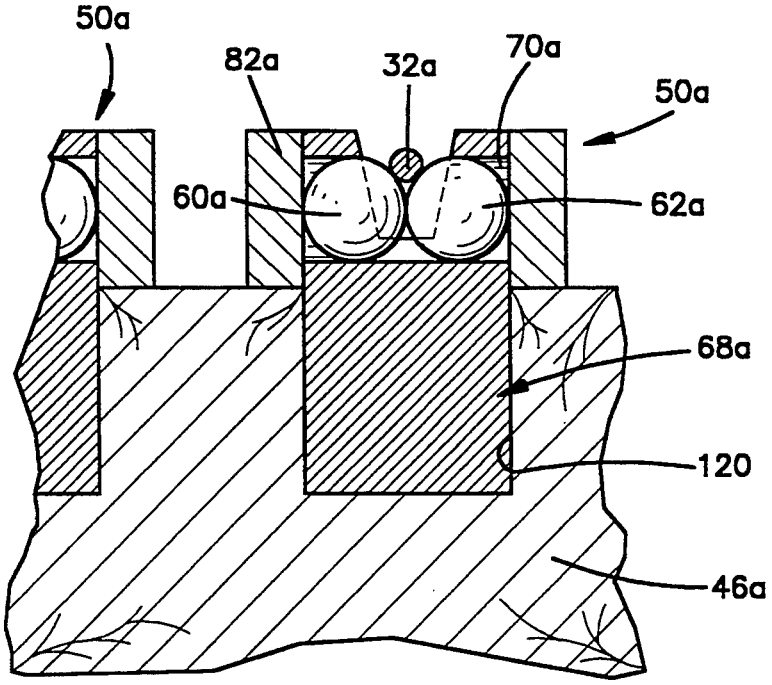
FIG. 6 is a fragmentary sectional view, taken generally along the line 6—6 of FIG. 5, further illustrating the manner in which a string support assembly is mounted in the material of the musical instrument.

In the embodiment of the invention illustrated in FIGS. 1–4, the string support assemblies 50 are mounted in cylindrical openings 104 formed in the metal base 96. In the embodiment of the invention illustrated in FIGS. 5 and 6, the string support assemblies are mounted in openings formed directly in the material of the head and/or neck portions of the guitar. It is contemplated that this embodiment of the invention may be preferred due to the direct transmission of vibrations from each of the string support assemblies to the material forming the guitar. Since the embodiment of the invention illustrated in FIGS. 5 and 6 is generally similar to the embodiment of the invention illustrated in FIGS. 1–4, similar numerals will be utilized to designate similar components, the suffix letter "a" being associated with the numerals of FIGS. 5 and 6 to avoid confusion.

A guitar **10*a* has a neck portion 12*a* and a head portion 14*a*. Tuning devices corresponding to the tuning devices 16–26 are associated with each of a plurality of strings 30*a*–40*a*. Although only the tuning devices 16*a* and 18*a* have been shown in FIG. 5 in association with the strings 30*a* and 32*a*, it should be understood that other tuning devices are associated with the other strings 34*a*–40*a***.

A string support system **44*a* is provided adjacent to a connection 46*a* between the neck and head portions 12*a* and 14*a* of the guitar 10*a*. The string support system 44*a* positions the strings 30*a*–40*a* relative to the neck portion 12*a* and head portion 14*a* of the guitar 10*a***.

The string support system **44*a* includes a linear array of spaced apart string support assemblies 50*a*. Each of the string support assemblies 50*a* has the same construction as the string support assembly 50 of FIGS. 2–4. Thus, the string support assembly 50*a* (FIG. 6) includes a pair of spheres 60*a* and 62*a* which are rotatably supported in a cylindrical recess 70*a* formed in a cylindrical body 68*a*. An annular collar 82*a* extends around the body 68*a* and blocks opposite ends of the cylindrical recess 70*a* to hold the spheres 60*a* and 62*a*** in the recess.

In accordance with a feature of this embodiment of the invention, the cylindrical body **68*a* of each of the string supports 50*a* is disposed in a cylindrical recess 120 formed in the wooden material of the guitar 10*a***.

Thus, a linear array of spaced apart cylindrical openings 120 is formed in the wooden material of the guitar 10*a* adjacent to the connection 46*a* between the neck and head portions 12*a* and 14*a*. The cylindrical openings 120 have parallel central axes.

The string support assembly 50*a* for each of the strings 30*a*–40*a* is received in one of the openings 120 formed in the material of the guitar 10*a*. Therefore, vibrations can be transmitted directly from the strings 30*a*–40*a* to the wooden material of the guitar 10*a* through each of the string support assemblies 50*a*. Of course, the guitar could be formed of a material other than wood if desired.

It is contemplated that it may be desirable to provide for adjustment of the height of the spheres 60*a* and 62*a* above an upper side surface of the guitar. This may be done by providing adjustment screws corresponding to the adjustment screw 108 of FIG. 3. In the embodiment of the invention illustrated in FIGS. 5 and 6, the adjustment screws would be mounted in the cylindrical bodies 68*a*.

It is contemplated that the string support system 44*a* of FIGS. 5 and 6 may be retrofitted onto existing guitars. This may be done by using the nut on the existing guitar to align a jig having a linear array of openings. A dovetail drill would then be used to form a linear array of holes having their centers along the edge of the nut toward the neck portion of the guitar. Once the holes have been drilled, the nut would be ground away to the same curvature as the neck portion of the guitar. The string support assemblies 50*a* would then be mounted in the drilled openings or recesses in the guitar.

In view of the foregoing description, it is apparent that the present invention provides a new and improved string support system 44 which is used in a musical instrument 10 of the guitar type. This type of musical instrument commonly has a plurality of strings 30–40 which extend from tuning devices 16–26 on a head portion 14, along a neck portion 12, to a body portion of the instrument. The improved string support system 44 positions the strings 30–40 relative to the head and neck portions of the instrument.

The string support system 44 includes a plurality of string support assemblies 50. Each of the string support assemblies 50 has a pair of convex arcuate surfaces which cooperate to engage a string. The convex arcuate surfaces may be disposed on spherical members 60 and 62. The spherical members 60 and 62 may be rotatably held in a recess 70 formed in a support member 68. The support member 68 may be mounted on a base 96 which is in turn mounted on the instrument 10 (FIG. 3) or may be mounted directly in the material of the instrument (FIG. 6).

Having described the invention, the following is claimed:

1. A stringed musical instrument, said musical instrument comprising a body portion, a neck portion at least partially formed of a first material and connected with an extending outward from said body portion, a head portion at least partially formed of the first material and connected with said neck portion, surface means for defining a plurality of spaced apart openings in the first material adjacent to said head and neck portions, a plurality of tuning devices mounted on said head portion, a plurality of strings each of which extends from one of said tuning devices along said neck portion to said body portion of said instrument, and a plurality of spaced apart string supports mounted on said musical instrument adjacent to a connection between said head and neck portions, each of said string supports of said plurality of string supports being at least partially disposed in one of said openings, each of said string supports of said plurality of string supports including first convex arcuate string support surface means which engages and at least partially supports one string of said plurality of strings and which forms at least a portion of an outer side of a first sphere, a second convex arcuate string support surface means which engages and at least partially supports said one string of said plurality of strings and which forms at least a portion of an outer side of a second sphere, and support means for supporting said first and second convex arcuate string support surface means, said support means being at least partially disposed in one of said openings in engagement with the first material adjacent to said head and neck portions of said instrument to enable vibrations to be transmitted from said first and second convex arcuate string support surface means through said support means to the first material adjacent to said head and neck portions of said instrument, said support means in each string support of said plurality of string supports being spaced from adjacent string supports of said plurality of string supports, each string of said plurality of strings being disposed in engagement with said first and second convex arcuate string support surface means in one of said string supports of said plurality of string supports.

2. A stringed musical instrument as set forth in claim 1 wherein said support means in each string support of said plurality of string supports has a cylindrical outer side surface area which is disposed in engagement with the first material.

3. A stringed musical instrument as set forth in claim 1 wherein said support means in each string support of said plurality of string supports includes surface means for defining a recess in which said first and second convex arcuate support surface means are disposed.

4. A stringed musical instrument as set forth in claim 3 further including an annular collar member which extends around said support means to retain said first and second convex arcuate support surface means in said recess.

5. A stringed musical instrument as set forth in claim 1 wherein said first convex arcuate support surface means defines a first spherical member and said second convex arcuate support surface means defines a second spherical member.

6. A stringed musical instrument said musical instrument comprising a body portion, a neck portion at least partially formed of a first material and connected with and extending outward from said body portion, a head portion at least partially formed of the first material and connected with said neck portion, a plurality of tuning devices mounted on said head portion, a plurality of strings each of which extends from one of said tuning devices along said neck portion to said body portion of said instrument, slot forming surface means for defining a slot in the first material adjacent to a connection between said head and neck portions and extending beneath each of said strings of said plurality of strings, a base disposed in said slot, said base having an upper side surface which extends beneath each of the strings of said plurality of strings and faces upward toward the strings of said plurality of strings, and a plurality of pairs of members disposed on said base and at least partially disposed above said upper side surface of said base with each string of said plurality of strings in engagement with one of said pairs of members at a location above the upper side surface of said base, each of said pairs of members including a first member having a first convex arcuate surface which forms at least a portion of an outer side surface of a first sphere and a second member having a second convex arcuate surface which forms at least a portion of an outer side surface of a second sphere, each string of said plurality of strings being disposed in engagement with said first and second convex arcuate surfaces on said first and second members in one of said pairs of members at a location above said upper side surface of said base.

7. A stringed musical instrument as set forth in claim 6 further including means for adjusting the position of said plurality of pairs of members relative to said neck portion of said musical instrument to adjust the positions of said plurality of strings relative to said neck portion of said musical instrument.

8. A stringed musical instrument as set forth in claim 6 wherein said first member in each of said pairs of members is rotatable about the center of curvature of said first convex arcuate surface in a first direction under the influence of force applied against said first convex arcuate surface by one of the strings of said plurality of strings, said second member in each of said pairs of members being rotatable about the center of curvature of said second convex arcuate surface in a second direction under the influence of force applied against said second convex arcuate surface by the one string of the plurality of strings.

9. A stringed musical instrument, said musical instrument comprising a body portion, a neck portion connected with and extending outwardly from said body portion, a head portion connected with said neck portion, a plurality of tuning devices mounted on said head portion, a plurality of strings each of which extends from one of said tuning devices along said neck portion and said body portion of said musical instrument, a base mounted on said musical instrument and extending beneath said strings, and a plurality of pairs of spheres disposed on said base, each string of said plurality of strings being disposed in engagement with a pair of spheres of said plurality of pairs of spheres, said base having an upper side surface which faces toward the plurality of strings, each sphere of said plurality of pairs of spheres having a center of curvature which is disposed above the upper side surface of said base.

10. A stringed musical instrument as set forth in claim 9 further including adjustment means for adjusting the positions of said plurality of pairs of spheres relative to the musical instrument in a direction transverse to longitudinal axes of the strings.

11. A stringed musical instrument as set forth in claim 10 wherein each pair of spheres of said plurality of pairs of spheres includes a first spherical member having a first convex arcuate surface and a second spherical member having a second convex arcuate surface, one of said strings of said plurality of strings being disposed in engagement with said first convex arcuate surface on said first spherical member and with said second convex arcuate surface on said second spherical member of each pair of spheres of said plurality of pairs of spheres.

12. A stringed musical instrument as set forth in claim 11 wherein said first and second spherical members in each of said plurality of pairs of spheres are rotatable about their centers of curvature relative to said base.

13. A stringed musical instrument as set forth in claim 11 wherein said first and second convex arcuate surfaces on said first and second spherical members are disposed in abutting engagement.

14. A stringed musical instrument as set forth in claim 11 wherein said first convex arcuate surface on said first spherical member of each of said plurality of pairs of spheres has a center of curvature which is spaced from a center of curvature of said second convex arcuate surface on said second spherical member of each of said plurality of pairs of spheres by a distance which is greater than the diameter of the one string of the plurality of strings which is disposed in engagement with said first convex arcuate surface on said first spherical member of each of said pairs of spheres and said second convex arcuate surface on said second spherical member of each of said pairs of spheres.

15. A stringed musical instrument as set forth in claim 9 further including a plurality of connector means for connecting said plurality of pairs of spheres with said base with said plurality of pairs of spheres in a spaced apart relationship.

16. A stringed musical instrument as set forth in claim 15 wherein said plurality of connector means engage surfaces of a plurality of openings formed in a linear array in said base.

17. A stringed musical instrument as set forth in claim 16 wherein each of said connector means includes a body which is received in one of the openings in the linear array of openings, said body in each of said connector means having a recess in which one pair of spheres of said plurality of pairs of spheres is disposed.

18. A stringed musical instrument, said musical instrument comprising a body portion, a neck portion connected with and extending outward from said body portion, a head portion connected with said neck portion, a plurality of tuning devices mounted on said head portion, a plurality of strings each of which extends from one of said tuning devices along the neck portion to the body portion of said instrument, and a plurality of spaced apart string supports mounted on said musical instrument adjacent to a connection between said head and neck portions, each of said string supports of said plurality of string supports including a first convex arcuate surface which forms at least a portion of an outer side of a first sphere, a second convex arcuate surface which forms at least a portion of an outer side of a second sphere, and a support body which supports said first and second convex arcuate surfaces, said support bodies of said plurality of string supports being disposed in a linear array with said support bodies spaced apart from each other and with each string of said plurality of strings disposed in engagement with said first and second convex arcuate surfaces in one of said string supports of said plurality of string supports, said head and neck portions being formed of wood with a plurality of spaced apart openings formed in the wood adjacent to the connection between said head and neck portions, each of said support bodies of said plurality of string supports being formed of metal and being at least partially disposed in one of the openings formed in the wood and spaced apart from adjacent one of said support bodies.

19. A stringed musical instrument as set forth in claim 18 wherein each of said string supports of said plurality of string supports includes a first spherical member, said first convex arcuate surface being disposed on said first spherical member, and a second spherical member, said second convex arcuate surface being disposed on said second spherical member, said first and second spherical members in each of said string supports being enclosed by one of said support bodies of said plurality of support bodies.

20. A stringed musical instrument as set forth in claim 19 wherein each of said support bodies includes means for rotatably supporting said first and second spherical members.

21. A stringed musical instrument as set forth in claim 18 wherein said plurality of strings have a plurality of different diameters, said first convex arcuate surface having a center of curvature which is spaced from a center of curvature of said second convex arcuate surface by a distance which is greater than the diameter of at least some of the strings of said plurality of strings.

22. A stringed musical instrument, said musical instrument comprising a body portion, a neck portion connected with and extending outward from said body portion, a head portion connected with said neck portion, a plurality of tuning devices mounted on said head portion, a plurality of strings each of which extends from one of said tuning devices along the neck portion to the body portion of said instrument, and a plurality of spaced apart string supports mounted on said musical instrument adjacent to a connection between said head and neck portions, each of said string supports of said plurality of string supports including a first convex arcuate surface which forms at least a portion of an outer side of a first sphere, a second convex arcuate surface which forms at least a portion of an outer side of a second sphere, and a support body which supports said first and second convex arcuate surfaces, said support bodies of said plurality of string supports being disposed in a linear array with said support bodies spaced apart from each other and with each string of said plurality of strings disposed in engagement with said first and second convex arcuate surfaces in one of said string supports of said plurality of string supports, each of said string supports of said plurality of string supports includes a first spherical member, said first convex arcuate surface being disposed on said first spherical member, and a second spherical member, said second convex arcuate surface being disposed on said second spherical member, said first and second spherical members in each of said string supports being enclosed by one of said support bodies of said plurality of support bodies.

23. A stringed musical instrument as set forth in claim 22 wherein each of said support bodies includes means for rotatably supporting said first and second spherical members.

24. A stringed musical instrument as set forth in claim 22 wherein said plurality of strings have a plurality of different diameters, said first convex arcuate surface having a center of curvature which is spaced from a center of curvature of said second convex arcuate surface by a distance which is greater than the diameter of at least some of the strings of said plurality of strings.

25. A stringed musical instrument as set forth in claim 22 wherein said head and neck portions are formed of wood with slot formed in the wood and extending transversely to said plurality of strings, said support means including a metal base disposed in the slot formed in the wood and extending beneath each of the strings of said plurality of strings, said metal base having surface means for defining a plurality of spaced apart openings, each of said support bodies being disposed in one of the openings in said metal base.

26. A stringed musical instrument as set forth in claim 22 further including a slot formed in said musical instrument adjacent to the connection between said head and neck portions, a base member disposed in said slot, said base member having an upper side surface which is disposed beneath and faces upward toward said strings of said plurality of strings, said first and second convex arcuate surfaces in each of said string supports having centers of curvature which are disposed above the upper side surface of said base member.

27. A stringed musical instrument as set forth in claim 22 further including a linear array of spaced apart openings adjacent to the connection between said head and neck portions, a portion of each of said support bodies of said plurality of string supports being disposed in one of the openings.

28. A stringed musical instrument as set forth in claim 22 further including a linear array of spaced apart openings formed said musical instrument adjacent to said head and neck portions, a portion of each of said support bodies of said plurality of string supports being disposed in one of the openings formed in the material of said musical instrument and being spaced apart from adjacent support bodies by the material of said musical instrument.

29. A stringed musical instrument, said musical instrument comprising a body portion, a neck portion at least partially formed of a first material and connected with and extending outward from said body portion, a head portion at least partially formed of the first material and connected with said neck portion, a plurality of tuning devices mounted on said head portion, a plurality of strings each of which extends from one of said tuning devices along said neck portion to said body portion of said instrument, slot defining surface means for defining a slot in the first material adjacent to a connection between said head and neck portions and extending beneath each of said strings of said plurality of strings, a base disposed in said slot, said base having an upper side surface which extends beneath each of the strings of said plurality of strings and faces upward toward the strings of said plurality of strings, and a plurality of pairs of members disposed on said base and at least partially disposed above said upper side surface of said base with each string of said plurality of strings in engagement with one of said pairs of members at a location above the upper side surface of said base, each of said pairs of members including a first member having a first convex arcuate surface which forms at least a portion of an outer side surface of a first sphere and a second member having a second convex arcuate surface which forms at least a portion of an outer side surface of a second sphere, said first and second members in each of said pairs of members being spheres which are connected with said base, each string of said plurality of strings being disposed in engagement with said first and second convex arcuate surfaces on said first and second members in one of said pairs of members at a location above said upper side surface of said base.

30. A stringed musical instrument as set forth in claim 29 further including means for adjusting the position of said plurality of pairs of members relative to said neck portion of said musical instrument to adjust the positions of said plurality of strings relative to said neck portion of said musical instrument.

* * * * *

UNITED STATES PATENT AND TRADEMARK OFFICE

CERTIFICATE OF CORRECTION

PATENT NO. : 5,438,901

DATED : August 8, 1995

INVENTOR(S) : Robert J. Sperzel

It is certified that error appears in the above-indentified patent and that said Letters Patent is hereby corrected as shown below:

Column 9, line 56, change "10" to --9--.

Column 11, line 63, after "with" insert --a--.

Signed and Sealed this

Twenty-sixth Day of March, 1996

Bruce Lehman

*Attest:*

BRUCE LEHMAN

*Attesting Officer*

*Commissioner of Patents and Trademarks*